US011727835B2

(12) United States Patent
Ha et al.

(10) Patent No.: US 11,727,835 B2
(45) Date of Patent: Aug. 15, 2023

(54) PIXEL CIRCUIT, DISPLAY APPARATUS INCLUDING THE SAME AND METHOD OF DRIVING THE SAME

(71) Applicant: Samsung Display Co., Ltd., Yongin-Si (KR)

(72) Inventors: Tae-Seok Ha, Hwaseong-si (KR); Kyoungsoo Kim, Suwon-si (KR); Kyu-Jin Park, Hwaseong-si (KR); Sung-Jae Park, Seongnam-si (KR); Seung-Woon Shin, Asan-si (KR); Ho Lee, Seoul (KR); Woon-Rok Jang, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/568,289

(22) Filed: Jan. 4, 2022

(65) Prior Publication Data

US 2022/0270528 A1 Aug. 25, 2022

(30) Foreign Application Priority Data

Feb. 23, 2021 (KR) ..... 10-2021-0024384

(51) Int. Cl.
*G09G 3/00* (2006.01)

(52) U.S. Cl.
CPC ..... *G09G 3/006* (2013.01); *G09G 2310/0275* (2013.01); *G09G 2330/028* (2013.01)

(58) Field of Classification Search
CPC ..... G09G 3/006; G09G 2310/0275; G09G 2330/028; G09G 2230/00;
(Continued)

(56) References Cited

U.S. PATENT DOCUMENTS 5,313,579 A * 5/1994 Chao ..... H04L 12/5602 370/230.1
7,355,574 B1 * 4/2008 Leon ..... G09G 3/3233 345/82
(Continued)

FOREIGN PATENT DOCUMENTS

KR 100560780 B1 3/2006
KR 1020180007212 A 1/2018
(Continued)

*Primary Examiner* — Jose R Soto Lopez
(74) *Attorney, Agent, or Firm* — Cantor Colburn LLP

(57) ABSTRACT

A pixel circuit includes a light emitting element including a first electrode and a second electrode, a first switching element including a control electrode, a second switching element, a third switching element, a sensing resistor and a fourth switching element. The first switching element applies a first power voltage to the first electrode of the light emitting element. The second switching element applies a data voltage to the control electrode of the first switching element. The third switching element senses a signal of the first electrode of the light emitting element. The sensing resistor includes a first end connected to the second electrode of the light emitting element and a second end which receives a second power voltage. The fourth switching element senses a signal of the second electrode of the light emitting element.

20 Claims, 10 Drawing Sheets

(58) Field of Classification Search
CPC ... G09G 2300/0408; G09G 2320/0673; G09G 2330/021; G09G 2330/12; G09G 3/3258; G09G 3/3225; G09G 3/3648; G09G 2320/0233; G09G 2320/0242; G09G 3/3233; G09G 3/3275; G09G 2330/00
See application file for complete search history.

(56) References Cited

U.S. PATENT DOCUMENTS

| | | | | |
|---|---|---|---|---|
| 8,823,616 | B2 * | 9/2014 | Kim | G09G 3/3696 345/204 |
| 10,957,243 | B1 * | 3/2021 | Liu | G09G 3/32 |
| 11,164,494 | B1 * | 11/2021 | Hashimoto | G09G 3/3233 |
| 2005/0062696 | A1 * | 3/2005 | Lo | G09G 3/3233 345/82 |
| 2007/0080905 | A1 * | 4/2007 | Takahara | G09G 3/3258 345/76 |
| 2008/0290806 | A1 * | 11/2008 | Tada | G09G 3/3233 315/307 |
| 2008/0297055 | A1 * | 12/2008 | Miyake | G09G 3/3233 315/169.2 |
| 2011/0212810 | A1 * | 9/2011 | Jeka | A63B 24/0087 482/9 |
| 2011/0230792 | A1 * | 9/2011 | Sarig-Bahat | A61B 5/1124 600/595 |
| 2011/0279128 | A1 * | 11/2011 | Von Staudt | G09G 3/006 324/538 |
| 2012/0068986 | A1 * | 3/2012 | Mizutani | G09G 3/3225 345/211 |
| 2012/0133655 | A1 * | 5/2012 | Kristjansson | A61B 5/1122 702/19 |
| 2012/0169704 | A1 * | 7/2012 | Chung | G09G 3/3233 345/212 |
| 2014/0276130 | A1 * | 9/2014 | Mirelman | A61B 5/1104 600/595 |
| 2015/0064662 | A1 * | 3/2015 | Slutzky | A61B 5/486 434/118 |
| 2015/0187278 | A1 * | 7/2015 | Park | G09G 3/3291 345/212 |
| 2016/0012767 | A1 * | 1/2016 | Nebon | G09G 3/3225 345/82 |
| 2016/0300534 | A1 * | 10/2016 | Kishi | G09G 3/3283 |
| 2017/0004776 | A1 * | 1/2017 | Park | G09G 3/3233 |
| 2017/0025061 | A1 * | 1/2017 | Takizawa | G09G 3/3291 |
| 2017/0032736 | A1 * | 2/2017 | Gu | G09G 3/3208 |
| 2017/0061871 | A1 * | 3/2017 | Xiang | G09G 3/3233 |
| 2017/0132977 | A1 * | 5/2017 | Kim | G09G 3/3291 |
| 2017/0193918 | A1 * | 7/2017 | Bae | G09G 3/3291 |
| 2017/0206836 | A1 * | 7/2017 | Kim | G09G 3/3233 |
| 2017/0282015 | A1 * | 10/2017 | Wicks | A63B 24/0075 |
| 2018/0061314 | A1 * | 3/2018 | Kim | G09G 3/3233 |
| 2018/0174522 | A1 * | 6/2018 | Lee | G09G 3/3291 |
| 2018/0190192 | A1 * | 7/2018 | Kwon | G09G 3/3233 |
| 2018/0366061 | A1 * | 12/2018 | Furukawa | G09G 3/20 |
| 2019/0081261 | A1 * | 3/2019 | Lee | C09K 11/08 |
| 2019/0088152 | A1 * | 3/2019 | Adamovich | A61B 5/1128 |
| 2019/0164485 | A1 * | 5/2019 | Tomitani | G09G 3/3233 |
| 2019/0180693 | A1 * | 6/2019 | Kim | G09G 3/3275 |
| 2019/0228709 | A1 * | 7/2019 | Wang | H10K 50/82 |
| 2020/0035165 | A1 * | 1/2020 | Park | G09G 3/3258 |
| 2020/0051500 | A1 * | 2/2020 | Lin | G09G 3/3225 |
| 2020/0152125 | A1 * | 5/2020 | Ye | G09G 3/3233 |
| 2020/0152126 | A1 * | 5/2020 | Jo | H10K 59/351 |
| 2020/0219915 | A1 * | 7/2020 | Kim | G06V 40/1318 |
| 2020/0388218 | A1 * | 12/2020 | Han | G09G 3/3233 |
| 2021/0020102 | A1 * | 1/2021 | Yamamoto | G09G 3/3233 |
| 2021/0035501 | A1 * | 2/2021 | Feng | G09G 3/3283 |
| 2021/0049964 | A1 * | 2/2021 | Yuan | G09G 3/3241 |
| 2021/0201787 | A1 * | 7/2021 | Yuan | G09G 3/3241 |
| 2021/0201825 | A1 * | 7/2021 | Yun | G09G 3/3225 |
| 2021/0335232 | A1 * | 10/2021 | Jiang | G09G 3/3233 |
| 2021/0335258 | A1 * | 10/2021 | Bao | G09G 3/3233 |
| 2021/0366388 | A1 * | 11/2021 | Song | G09G 3/3233 |
| 2021/0407385 | A1 * | 12/2021 | Ikeda | G09G 3/32 |
| 2022/0012453 | A1 * | 1/2022 | Choi | H10K 59/1213 |
| 2022/0076602 | A1 * | 3/2022 | Dong | G09G 3/006 |
| 2022/0122545 | A1 * | 4/2022 | Hong | H10K 50/11 |
| 2022/0139332 | A1 * | 5/2022 | Park | G09G 3/3283 345/214 |
| 2022/0206652 | A1 * | 6/2022 | Lee | G06F 3/0443 |
| 2022/0208045 | A1 * | 6/2022 | Kwon | G09G 3/3258 |

FOREIGN PATENT DOCUMENTS

| | | | |
|---|---|---|---|
| KR | 1020190020261 | A | 2/2019 |
| KR | 1020200080206 | A | 10/2020 |

* cited by examiner

| | | | | | | | |
|---|---|---|---|---|---|---|---|
| ELVDD(N) | 32 | 31 | 30 | 29 | 28 | 27 | 26 |
| | SATURATION | | | | | LINEAR | |
| ELVDD(M) | 30 | 29 | 28 | 27 | 26 | 25 | 24 |
| | SATURATION | | | LINEAR | | | |
| ΔVr(VN-VM) | 0.5 | 0.5 | 0.5 | 0.6 | 0.7 | 0.8 | 1 |

PIXEL CIRCUIT, DISPLAY APPARATUS INCLUDING THE SAME AND METHOD OF DRIVING THE SAME

This application claims priority to Korean Patent Application No. 10-2021-0024384, filed on Feb. 23, 2021, and all the benefits accruing therefrom under 35 U.S.C. § 119, the content of which in its entirety is herein incorporated by reference.

BACKGROUND

1. Field

Embodiments of the invention relate to a pixel circuit, a display apparatus including the pixel circuit and a method of driving the display apparatus. More particularly, embodiments of the invention relate to a pixel circuit determining a limit value of a power voltage using a sensing resistor and a sensing switching element, a display apparatus including the pixel circuit and a method of driving the display apparatus.

2. Description of the Related Art

Generally, a display apparatus includes a display panel and a display panel driver. The display panel includes a plurality of gate lines, a plurality of data lines and a plurality of pixels. The display panel driver includes a gate driver and a data driver. The gate driver outputs gate signals to the gate lines. The data driver outputs data voltages to the data lines. The display panel driver may further include a power voltage generator applying a power voltage to the pixel.

A level of the power voltage applied to the pixel may be adjusted for a purpose of reducing a power consumption of the display panel or for other purposes.

SUMMARY

A level of the power voltage applied to the pixel may be adjusted for a purpose of reducing a power consumption of the display panel or other purposes. As a size of the display panel increases, the level of the power voltage may be decreased in a region far from the power voltage generator due to a voltage ("IR") drop. When the level of the power voltage is excessively decreased, the display quality deterioration such as luminance abnormality or color coordination abnormality may occur in a portion of the display panel due to the IR drop.

Embodiments of the invention provide a pixel circuit determining a limit value of a power voltage using a sensing resistor and a sensing switching element.

Embodiments of the invention also provide a display apparatus including the pixel circuit.

Embodiments of the invention also provide a method of driving the display apparatus.

In an embodiment of a pixel circuit according to the invention, the pixel circuit includes a light emitting element including a first electrode and a second electrode, a first switching element including a control electrode, a second switching element, a third switching element, a sensing resistor and a fourth switching element. The first switching element applies a first power voltage to the first electrode of the light emitting element. The second switching element applies a data voltage to the control electrode of the first switching element. The third switching element senses a signal of the first electrode of the light emitting element. The sensing resistor includes a first end connected to the second electrode of the light emitting element and a second end which receives a second power voltage. The fourth switching element senses a signal of the second electrode of the light emitting element.

In an embodiment, in a first sensing mode, a first switching signal applied to a control electrode of the second switching element may have an inactive level, a second switching signal applied to a control electrode of the third switching element may have an inactive level and a fourth switching signal applied to a control electrode of the fourth switching element may have an active level.

In an embodiment, in a second sensing mode, the first switching signal may have the inactive level, the second switching signal may have an active level and the fourth switching signal may have an inactive level.

In an embodiment, the pixel circuit may further include an initialization voltage applying switch which applies an initialization voltage to a first sensing line connected to an output electrode of the third switching element.

In an embodiment, in an initialization voltage applying mode, the first switching signal may have an active level, the second switching signal may have the active level, a third switching signal applied to the initialization voltage applying switch may have an active level and the fourth switching signal may have the inactive level.

In an embodiment of a display apparatus according to the invention, the display apparatus includes a display panel, a data driver and a power voltage generator. The display panel includes a first pixel and a second pixel. The data driver applies a data voltage to the display panel. The power voltage generator applies a power voltage to the display panel. A distance between the first pixel and the power voltage generator is greater than a distance between the second pixel and the power voltage generator. Each of the first pixel and the second pixel includes a light emitting element including a first electrode and a second electrode, a first switching element which applies a first power voltage to the first electrode of the light emitting element and including a control electrode, a second switching element which applies the data voltage to the control electrode of the first switching element, a third switching element which senses a signal of the first electrode of the light emitting element, a sensing resistor including a first end connected to the second electrode of the light emitting element and a second end which receives a second power voltage and a fourth switching element which senses a signal of the second electrode of the light emitting element.

In an embodiment, the display panel may further include a third pixel. The third pixel may include the light emitting element, the first switching element, the second switching element and the third switching element. The third pixel may not include the sensing resistor and the fourth switching element.

In an embodiment, a data voltage applied to the second switching element of the first pixel may be greater than a data voltage applied to the second switching element of the third pixel for a same grayscale value.

In an embodiment, a limit value of the first power voltage may be determined using a difference of a first sensed voltage sensed at the fourth switching element of the first pixel and a second sensed voltage sensed at the fourth switching element of the second pixel.

In an embodiment, as the first power voltage is gradually decreased from a maximum setting value, a minimum value of the first power voltage at which the difference of the first sensed voltage sensed at the fourth switching element of the first pixel and the second sensed voltage sensed at the fourth switching element of the second pixel is maintained constantly may be determined as the limit value of the first power voltage.

In an embodiment, the display apparatus may further include a driving controller which controls the data driver and the power voltage generator. The driving controller may compensate the first power voltage using the limit value of the first power voltage.

In an embodiment, when the power voltage generator is disposed adjacent to a lower side of the display panel, the first pixel may be disposed at an upper portion of a first lateral side perpendicular to the lower side and the second pixel may be disposed at a lower portion of the first lateral side.

In an embodiment, when the power voltage generator is disposed adjacent to a lower side of the display panel, the first pixel may be disposed at a central portion of an upper side of the display panel and the second pixel may be disposed at a central portion of the lower side of the display panel.

In an embodiment, the display panel may further include third to sixth pixels. Each of the third to sixth pixels may include a light emitting element including a first electrode and a second electrode, a first switching element which applies the first power voltage to the first electrode of the light emitting element and includes a control electrode, a second switching element which applies the data voltage to the control electrode of the first switching element, a third switching element which senses a signal of the first electrode of the light emitting element, a sensing resistor including a first end connected to the second electrode of the light emitting element and a second end which receives the second power voltage and a fourth switching element which senses a signal of the second electrode of the light emitting element.

In an embodiment, when the power voltage generator is disposed adjacent to a lower side of the display panel, the first pixel may be disposed at an upper portion of a first lateral side perpendicular to the lower side, the second pixel may be disposed at a lower portion of the first lateral side, the third pixel may be disposed at a central portion of an upper side of the display panel, the fourth pixel may be disposed at a central portion of the lower side of the display panel, the fifth pixel may be disposed at an upper portion of a second lateral side opposite to the first lateral side and the sixth pixel may be disposed at a lower portion of the second lateral side.

In an embodiment, in a first sensing mode, a first switching signal applied to a control electrode of the second switching element may have an inactive level, a second switching signal applied to a control electrode of the third switching element may have an inactive level and a fourth switching signal applied to a control electrode of the fourth switching element may have an active level.

In an embodiment, in a second sensing mode, the first switching signal may have the inactive level, the second switching signal may have an active level and the fourth switching signal may have an inactive level.

In an embodiment, the display panel may further include an initialization voltage applying switch which applies an initialization voltage to a first sensing line connected to an output electrode of the third switching element.

In an embodiment, in an initialization voltage applying mode, the first switching signal may have an active level, the second switching signal may have the active level, a third switching signal applied to the initialization voltage applying switch may have an active level and the fourth switching signal may have the inactive level.

In an embodiment of a method of driving a display apparatus according to the invention includes sensing a first voltage from a cathode electrode of a light emitting element of a first pixel, sensing a second voltage from a cathode electrode of a light emitting element of a second pixel disposed closer to a power voltage generator than the first pixel is to the power voltage generator and determining a limit of a first power voltage which is applied from the power voltage generator to the first pixel and the second pixel based on a difference between the first voltage and the second voltage.

According to the pixel circuit, the display apparatus including the pixel circuit and the method of driving the display apparatus, the limit value of the power voltage may be determined using the sensing resistor and the sensing switching element included in the pixel circuit.

In addition, the display apparatus may be driven using the limit value of the power voltage so that the level of the power voltage may not be excessively decreased. Accordingly, the display quality deterioration such as the luminance abnormality or the color coordination abnormality in a portion of the display panel due to the IR drop may be prevented. Thus, the power consumption of the display apparatus may be reduced while maintaining the display quality of the display panel.

BRIEF DESCRIPTION OF THE DRAWINGS

The above and other features and advantages of the invention will become more apparent by describing in detailed embodiments thereof with reference to the accompanying drawings, in which.

DETAILED DESCRIPTION

Figure 1:
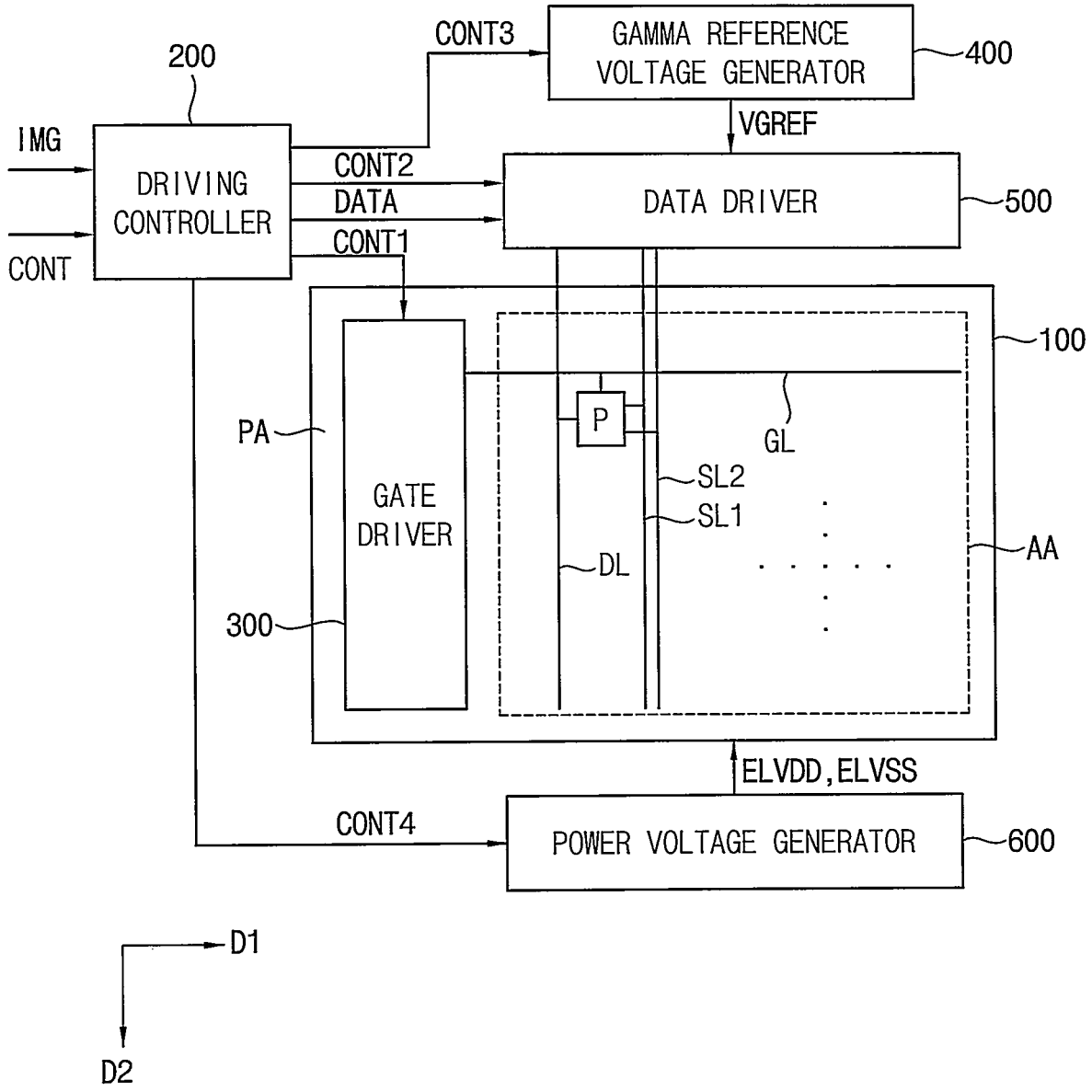
FIG. 1 is a block diagram illustrating an embodiment of a display apparatus according to the invention.

Hereinafter, the invention will be explained in detail with reference to the accompanying drawings.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

FIG. 1 is a block diagram illustrating an embodiment of a display apparatus according to the invention.

Referring to FIG. 1, the display apparatus includes a display panel 100 and a display panel driver. The display panel driver includes a driving controller 200, a gate driver 300, a gamma reference voltage generator 400 and a data driver 500. The display panel driver further includes a power voltage generator 600.

In an embodiment, the driving controller 200 and the data driver 500 may be integrally formed or provided, for example. In an embodiment, the driving controller 200, the gamma reference voltage generator 400 and the data driver 500 may be integrally formed or provided, for example. A driving module including at least the driving controller 200 and the data driver 500 which are integrally formed or provided may be referred to as to a timing controller embedded data driver ("TED").

The display panel 100 has a display region AA on which an image is displayed and a peripheral region PA adjacent to the display region AA.

In an embodiment, in the illustrated embodiment, the display panel 100 may be an organic light emitting diode display panel including an organic light emitting diode, for example. In an embodiment, the display panel 100 may be a quantum dot organic light emitting diode display panel including an organic light emitting diode and a quantum dot color filter, for example. In an alternative embodiment, the display panel 100 may be a liquid crystal display panel including a liquid crystal layer.

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1.

In the illustrated embodiment, the display panel 100 may further include a plurality of first sensing lines SL1 connected to the pixels P. The first sensing lines SL1 may extend in the second direction D2. The display panel 100 may further include a plurality of second sensing lines SL2 connected to the pixels P. The second sensing lines SL2 may extend in the second direction D2.

In the illustrated embodiment, the display panel driver may include a sensing circuit receiving a sensing signal from the pixels P of the display panel 100 through the first and second sensing lines SL1 and SL2. The sensing circuit may be disposed in the data driver 500. When the data driver 500 has an integrated chip ("IC") type, the sensing circuit may be disposed in a data driving IC. In an alternative embodiment, the sensing circuit may be formed or provided independently from the data driver 500. However, the invention may not be limited to a position of the sensing circuit.

The driving controller 200 receives input image data IMG and an input control signal CONT from an external apparatus. In an embodiment, the input image data IMG may include red image data, green image data and blue image data, for example. In an embodiment, the input image data IMG may include white image data, for example. In an embodiment, the input image data IMG may include magenta image data, yellow image data and cyan image data, for example. In an embodiment, the input control signal CONT may include a master clock signal and a data enable signal, for example. In an embodiment, the input control signal CONT may further include a vertical synchronizing signal and a horizontal synchronizing signal, for example.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. In an embodiment, the gate driver 300 may sequentially output the gate signals to the gate lines GL, for example.

In the illustrated embodiment, the gate driver 300 may be disposed (e.g., integrated) on the peripheral region PA of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600 may generate the power voltage and provide the power voltage to the display panel 100. In an embodiment, the power voltage generator 600 may provide a first power voltage ELVDD and a second power voltage ELVSS which are applied to the pixel P including a light emitting element to the display panel 100, for example. In an embodiment, the first power voltage ELVDD is a high power voltage and the second power voltage ELVSS is a low power voltage, for example.

The power voltage generator 600 may receive a fourth control signal CONT4 to adjust a level of the first and second power voltages ELVDD and ELVSS from the driving controller 200. The power voltage generator 600 may generate the first and second power voltages ELVDD and ELVSS based on the fourth control signal CONT4.

Figure 2:
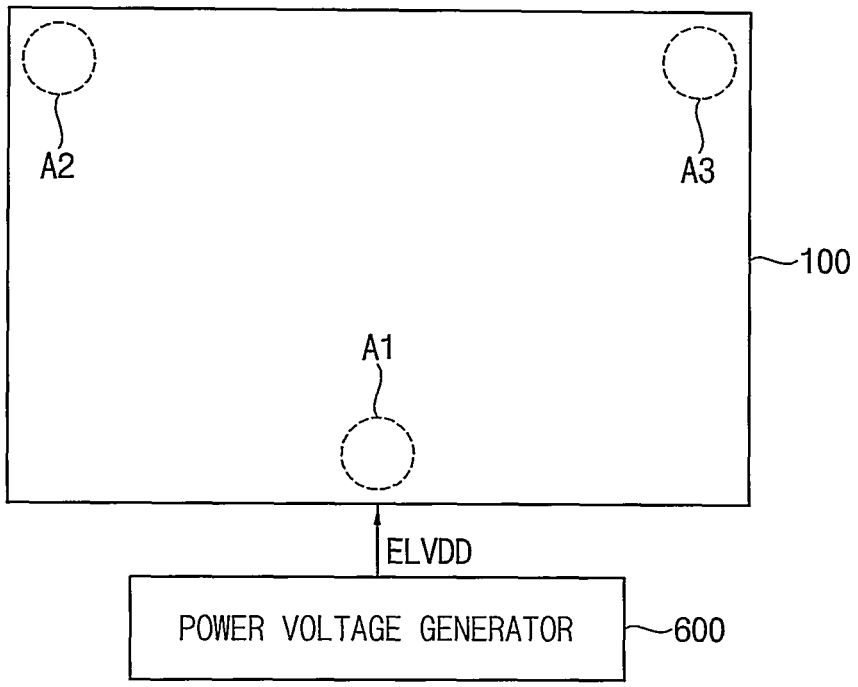
FIG. 2 is a conceptual diagram illustrating a display panel and a power voltage generator of FIG. 1.
Figure 3:
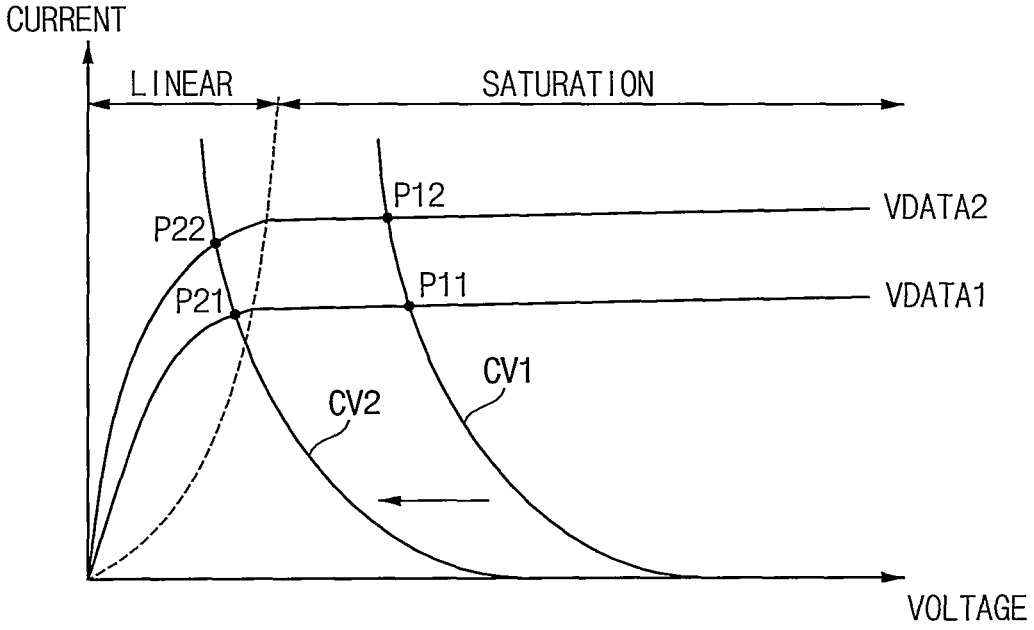
FIG. 3 is a graph illustrating a current-voltage curve of a pixel of FIG. 1.

FIG. 2 is a conceptual diagram illustrating the display panel 100 and the power voltage generator 600 of FIG. 1. FIG. 3 is a graph illustrating a current-voltage curve of the pixel P of FIG. 1.

Referring to FIGS. 1 to 3, the power voltage generator 600 may be disposed adjacent to a first side (e.g., lower side in FIG. 2) of the display panel 100. The first power voltage ELVDD generated by the power voltage generator 600 may be applied from the first side of the display panel 100 to a second side (e.g., upper side in FIG. 2) of the display panel 100 opposite to the first side of the display panel 100.

In an embodiment, the power voltage generator 600 may be disposed adjacent to a central portion of a lower side of the display panel 100 in FIG. 2, for example. A level of the first power voltage ELVDD at an area A1 which is close to the power voltage generator 600 may be relatively high.

In contrast, the level of the first power voltage ELVDD may decrease at areas A2 and A3 which are far from the power voltage generator 600 due to a voltage ("IR") drop. Accordingly, a luminance may be decreased at the areas A2 and A3 or color coordinates may be changed at the areas A2 and A3.

FIG. 3 represents the current-voltage curve of the pixel P. The area A1 where the level of the first power voltage ELVDD is relatively high may have a current-voltage curve of CV1. When a first data voltage VDATA1 is applied to the pixel P at the area A1, an operating point of the pixel P at the area A1 may be P11 where a characteristic curve of a thin film transistor ("TFT") according to the first data voltage VDATA1 and a characteristic curve CV1 of a diode meet. In addition, when a second data voltage VDATA2 is applied to the pixel P at the area A1, an operating point of the pixel P at the area A1 may be P12 where a characteristic curve of the TFT according to the second data voltage VDATA2 and the characteristic curve CV1 of the diode meet.

In contrast, the areas A2 and A3 where the level of the first power voltage ELVDD is decreased may have a current-voltage curve of CV2. When the first data voltage VDATA1 is applied to the pixel P at the areas A2 and A3, an operating point of the pixel P at the areas A2 and A3 may be P21 where the characteristic curve of the TFT according to the first data voltage VDATA1 and a characteristic curve CV2 of a diode meet. In addition, when a second data voltage VDATA2 is applied to the pixel P at the areas A2 and A3, an operating point of the pixel P at areas A2 and A3 may be P22 where the characteristic curve of the TFT according to the second data voltage VDATA2 and the characteristic curve CV2 of the diode meet.

The points where the CV1 curve meets the characteristic curve of the TFT according to the first data voltage VDATA1 and the characteristic curve of the TFT according to the second data voltage VDATA2 may be disposed in a saturation area of the TFT. In contrast, the points where the CV2 curve meets the characteristic curve of the TFT according to the first data voltage VDATA1 and the characteristic curve of the TFT according to the second data voltage VDATA2 may be disposed in a linear area of the TFT. Thus, as the level of the first power voltage ELVDD decreases, the luminance of the pixels P at the areas A2 and A3 may be greatly decreased.

Figure 4:
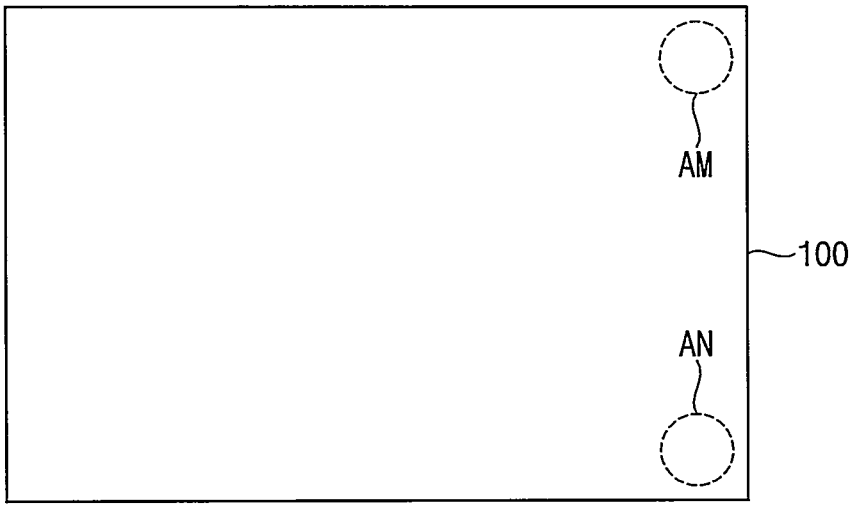
FIG. 4 is a conceptual diagram illustrating an embodiment of a first area and a second area of the display panel of FIG. 1.
Figure 5:
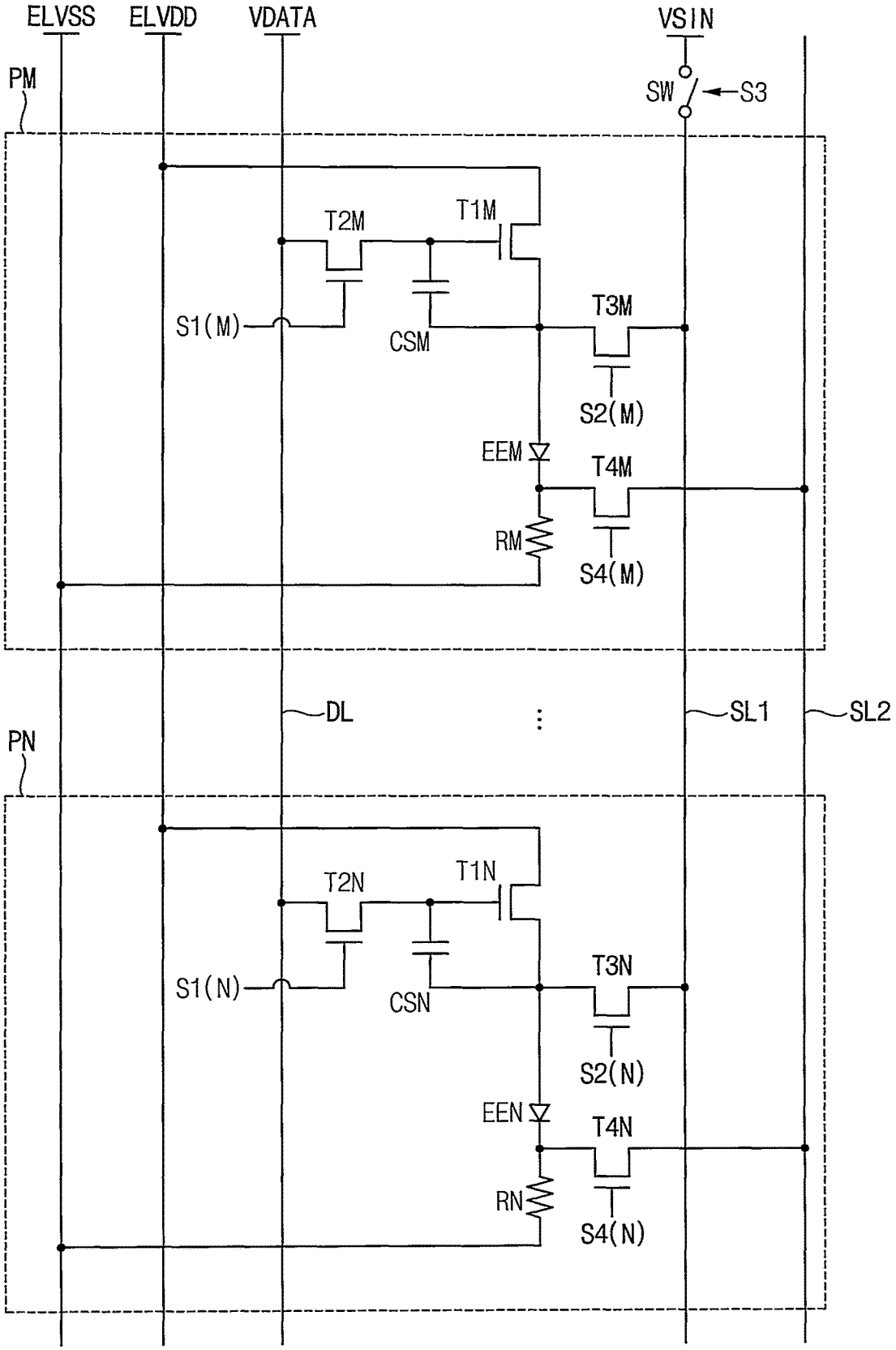
FIG. 5 is a circuit diagram illustrating a first pixel in the first area of FIG. 4 and a second pixel in the second area of FIG. 4.

FIG. 4 is a conceptual diagram illustrating an embodiment of a first area AM and a second area AN of the display panel 100 of FIG. 1. FIG. 5 is a circuit diagram illustrating a first pixel PM in the first area AM of FIG. 4 and a second pixel PN in the second area AN of FIG. 4.

Referring to FIGS. 1 to 5, a distance between the first pixel PM and the power voltage generator 600 may be greater than a distance between the second pixel PN and the power voltage generator 600.

In the illustrated embodiment, when the power voltage generator 600 is disposed adjacent to the lower side of the display panel 100, the first pixel PM may be disposed at an upper portion of a first lateral side (e.g., right side in FIG. 4) perpendicular to the lower side and the second pixel PN may be disposed at a lower portion of the first lateral side.

The first pixel PM may include a light emitting element EEM, a first switching element T1M applying the first power voltage ELVDD to a first electrode of the light emitting element EEM, a second switching element T2M applying the data voltage VDATA to a control electrode of the first switching element T1M, a third switching element T3M sensing a signal of the first electrode of the light emitting element EEM, a sensing resistor RM including a first end connected to a second electrode of the light emitting element EEM and a second end receiving the second power voltage ELVSS and a fourth switching element T4M sensing a signal of the second electrode of the light emitting element EEM. In addition, the first pixel PM may further include a storage capacitor CSM connected between the control electrode of the first switching element T1M and the first electrode of the light emitting element EEM.

Similarly, the second pixel PN may include a light emitting element EEN, a first switching element T1N applying the first power voltage ELVDD to a first electrode of the light emitting element EEN, a second switching element T2N applying the data voltage VDATA to a control electrode of the first switching element T1N, a third switching element T3N sensing a signal of the first electrode of the light emitting element EEN, a sensing resistor RN including a first end connected to a second electrode of the light emitting element EEN and a second end receiving the second power voltage ELVSS and a fourth switching element T4N sensing a signal of the second electrode of the light emitting element EEN. In addition, the second pixel PN may further include a storage capacitor CSN connected between the control electrode of the first switching element T1N and the first electrode of the light emitting element EEN.

The display panel 100 may further include a first sensing line SL1 connected to the third switching elements T3M and T3N of the first pixel PM and the second pixel PN. The display panel 100 may further include a second sensing line SL2 connected to the fourth switching elements T4M and T4N of the first pixel PM and the second pixel PN.

Figure 6:
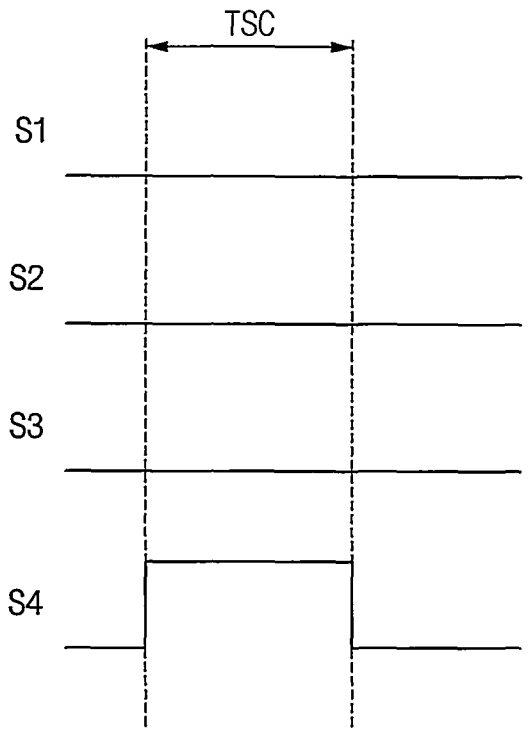
FIG. 6 is a timing diagram illustrating input signals of the pixels of FIG. 5 in a first sensing mode.
Figure 7:
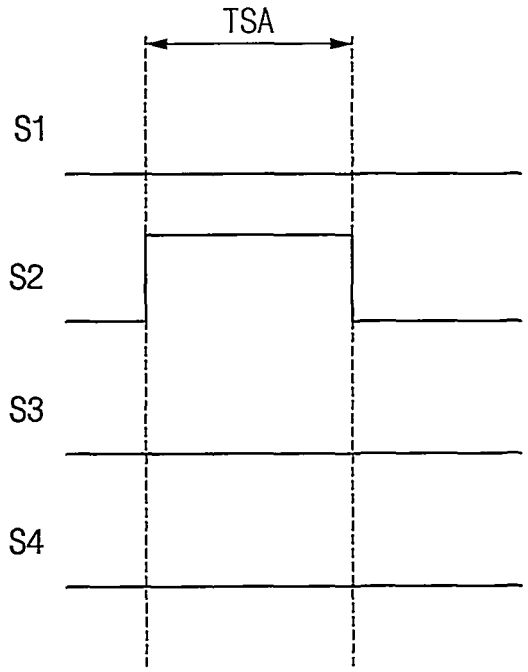
FIG. 7 is a timing diagram illustrating the input signals of the pixels of FIG. 5 in a second sensing mode.
Figure 8:
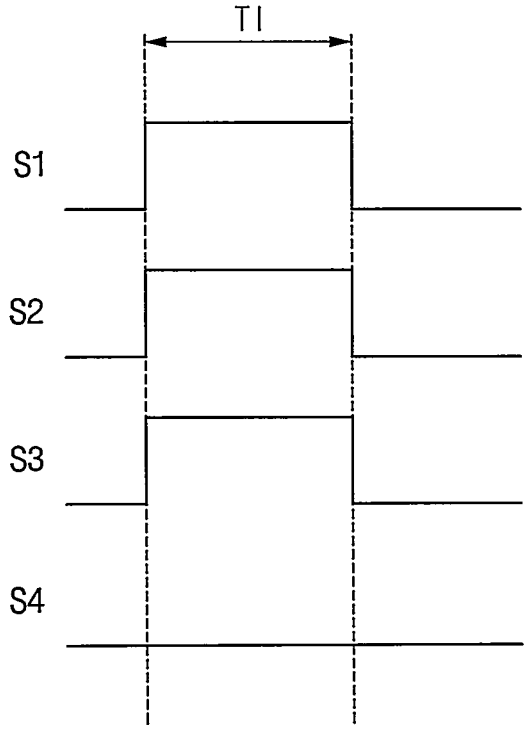
FIG. 8 is a timing diagram illustrating the input signals of the pixels of FIG. 5 in an initialization voltage applying mode.

FIG. 6 is a timing diagram illustrating input signals of the pixels of FIG. 5 in a first sensing mode. FIG. 7 is a timing diagram illustrating the input signals of the pixels of FIG. 5 in a second sensing mode. FIG. 8 is a timing diagram illustrating the input signals of the pixels of FIG. 5 in an initialization voltage applying mode.

Referring to FIGS. 1 to 8, in the first sensing mode, signals of cathode electrodes of the light emitting elements EEM and EEN may be sensed using the fourth switching elements T4M and T4N. In an embodiment, a limit value (e.g. a lower limit value) of the first power voltage (e.g., high power voltage) ELVDD may be determined based on the signals of the cathode electrodes of the light emitting elements EEM and EEN, for example. In an embodiment, the first sensing mode may operate in a vertical blank period, for example. In an active period, the gate signal (e.g. a first switching signal S1) may be scanned in the display panel 100 and the data voltage VDATA may be provided to the pixel (e.g. the control electrodes of the first switching elements T1M and T1N). The vertical blank period is disposed between the active periods. In the vertical blank period, the gate signal (e.g. the first switching signal S1) may not be scanned in the display panel 100.

As shown in FIG. 6, in a sensing period TSC of the first sensing mode, the first switching signal S1 applied to the control electrodes of the second switching elements T2M and T2N may have an inactive level, a second switching signal S2 applied to the control electrodes of the third switching elements T3M and T3N may have an inactive level and a fourth switching signal S4 applied to the control electrodes of the fourth switching elements T4M and T4N may have an active level.

In the second sensing mode, electrical characteristics of the first switching elements T1M and T1N may be sensed. In an embodiment, the electrical characteristics of the first switching elements T1M and T1N may be a mobility of the first switching elements T1M and T1N, for example. In an embodiment, the electrical characteristics of the first switching elements T1M and T1N may be a threshold voltage of the first switching elements T1M and T1N, for example. In the second sensing mode, electrical characteristics of the light emitting elements EEM and EEN may be sensed. In an embodiment, the electrical characteristics of the light emitting elements EEM and EEN may be a capacitance between first and second electrodes of the light emitting elements EEM and EEN, for example. In an embodiment, the second sensing mode may operate in the vertical blank period, for example.

As shown in FIG. 7, in a sensing period TSA of the second sensing mode, the first switching signal S1 may have an inactive level, the second switching signal S2 may have an active level and the fourth switching signal S4 may have an inactive level.

The display panel 100 may further include an initialization voltage applying switch SW applying an initialization voltage VSIN to the first sensing line SL1 connected to output electrodes of the third switching elements T3M and T3N.

In the sensing period TSA of the second sensing mode, a third switching signal S3 applied to the initialization voltage applying switch SW may have an inactive level. In the sensing period TSC of the first sensing mode, the third switching signal S3 applied to the initialization voltage applying switch SW may have the inactive level.

In the initialization voltage applying mode, the initialization voltage VSIN may be applied to the anode electrodes of the light emitting elements EEM and EEN. In an embodiment, the initialization voltage applying mode may operate in the active period, for example.

As shown in FIG. 8, in an initialization period TI of the initialization voltage applying mode, the first switching signal S1 may have an active level, the second switching signal S2 may have an active level, the third switching signal S3 may have an active level and the fourth switching signal S4 may have an inactive level.

Figures 9, 10:
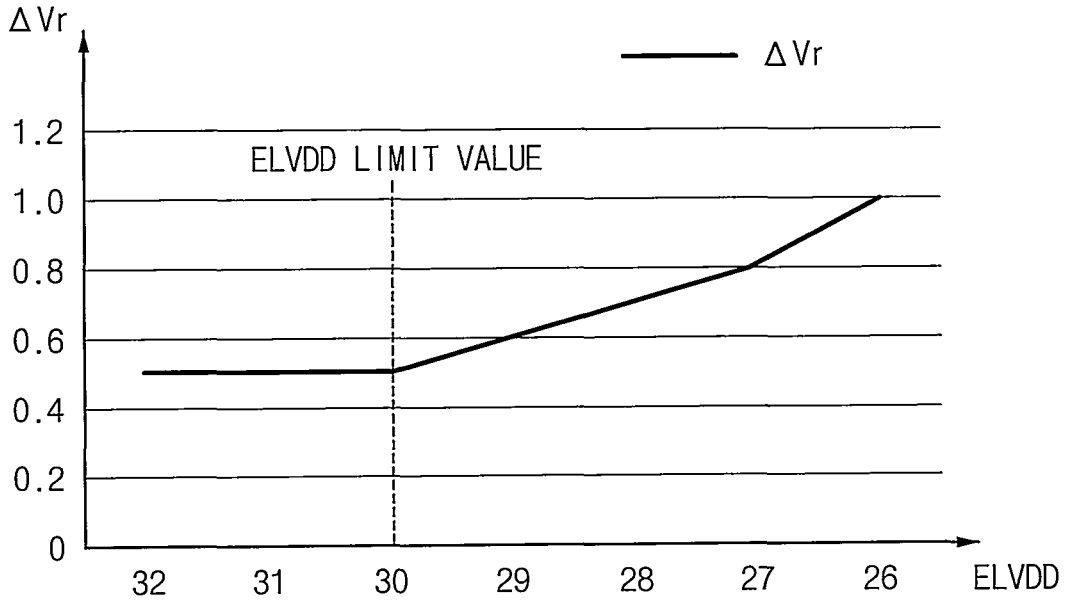
FIG. 9 is a table illustrating a method of determining a limit value of a first power voltage of FIG. 1.
FIG. 10 is a graph illustrating a method of determining the limit value of the first power voltage of FIG. 1.

FIG. 9 is a table illustrating a method of determining the limit value of the first power voltage ELVDD of FIG. 1. FIG.

10 is a graph illustrating a method of determining the limit value of the first power voltage ELVDD of FIG. 1.

Referring to FIGS. 1 to 10, the display apparatus may determine the limit value of the first power voltage ELVDD using a difference ΔVr of a first sensed voltage VM sensed at the fourth switching element T4M of the first pixel PM and a second sensed voltage VN sensed at the fourth switching element T4N of the second pixel PN.

In an embodiment, as the display apparatus gradually decreases the first power voltage ELVDD from a maximum setting value (e.g. 32V), the display apparatus may determine a minimum value of the first power voltage ELVDD at which the difference ΔVr of a first sensed voltage VM sensed at the fourth switching element T4M of the first pixel PM and a second sensed voltage VN sensed at the fourth switching element T4N of the second pixel PN is maintained constantly as the limit value of the first power voltage ELVDD, for example.

In an embodiment, the first switching elements T1M and T1N may be charged to the data voltage VDATA having the same grayscale value, the light emitting elements EEM and EEN may be emitted and the first power voltage ELVDD may be gradually decreased to sense the first sensed voltage VM and the second sensed voltage VN without a gating operation (S1 is inactivated), for example.

In an embodiment, during a first period, the first switching elements T1M and T1N may be charged to emit the light emitting elements EEM and EEN, for example. During a second period, the first switching signal S1 is inactivated, the first power voltage ELVDD of 32V is applied, and the fourth switching signal S4 is activated once so that the first sensed voltage VM and the second sensed voltage VN for the first power voltage ELVDD of 32V may be sensed. During a third period, the first switching signal S1 is inactivated, the first power voltage ELVDD of 31V is applied, and the fourth switching signal S4 is activated once so that the first sensed voltage VM and the second sensed voltage VN for the first power voltage ELVDD of 31V may be sensed. During a fourth period, the first switching signal S1 is inactivated, the first power voltage ELVDD of 30V is applied, and the fourth switching signal S4 is activated once so that the first sensed voltage VM and the second sensed voltage VN for the first power voltage ELVDD of 30V may be sensed.

As shown in the table in FIG. 9, ELVDD(N) represents an initial ELVDD outputted from the power voltage generator 600 (or sensed from the second pixel PN which is close to the power voltage generator 600) and ELVDD(M) represents ELVDD sensed from the first pixel PM which is far from the power voltage generator 600.

In an embodiment, when the initial ELVDD is 32V, the ELVDD sensed from the first pixel PM may be about 30 volts (V), for example. Herein, the difference ΔVr of the first sensed voltage VM sensed at the fourth switching element T4M of the first pixel PM and the second sensed voltage VN sensed at the fourth switching element T4N of the second pixel PN may be about 0.5V, for example. The difference ΔVr may correspond to a current flowing through the second sensing line SL2.

In an embodiment, when the initial ELVDD is 31V, the ELVDD sensed from the first pixel PM may be about 29V, for example. Herein, the difference ΔVr of the first sensed voltage VM sensed at the fourth switching element T4M of the first pixel PM and the second sensed voltage VN sensed at the fourth switching element T4N of the second pixel PN may be about 0.5V, for example.

In an embodiment, when the initial ELVDD is 30V, the ELVDD sensed from the first pixel PM may be about 28V, for example. Herein, the difference ΔVr of the first sensed voltage VM sensed at the fourth switching element T4M of the first pixel PM and the second sensed voltage VN sensed at the fourth switching element T4N of the second pixel PN may be about 0.5V, for example.

In an embodiment, when the initial ELVDD is 29V, the ELVDD sensed from the first pixel PM may be about 27V, for example. Herein, the difference ΔVr of the first sensed voltage VM sensed at the fourth switching element T4M of the first pixel PM and the second sensed voltage VN sensed at the fourth switching element T4N of the second pixel PN may be about 0.6V, for example.

The difference ΔVr may be constantly maintained to 0.5V from the initial ELVDD of 32V to 30V. However, when the initial ELVDD is 29V, the ΔVr may not be maintained to 0.5V but increased to 0.6V. The area in which the ΔVr increases may be determined to indicate that the switching element operates not in the saturation area but in the linear area.

Thus, the minimum value of the first power voltage ELVDD at which the difference ΔVr of a first sensed voltage VM sensed at the fourth switching element T4M of the first pixel PM and a second sensed voltage VN sensed at the fourth switching element T4N of the second pixel PN is maintained constantly may be determined as the limit value of the first power voltage ELVDD.

Herein, the driving controller 200 may compensate the first power voltage ELVDD using the limit value of the first power voltage ELVDD.

Figure 11:
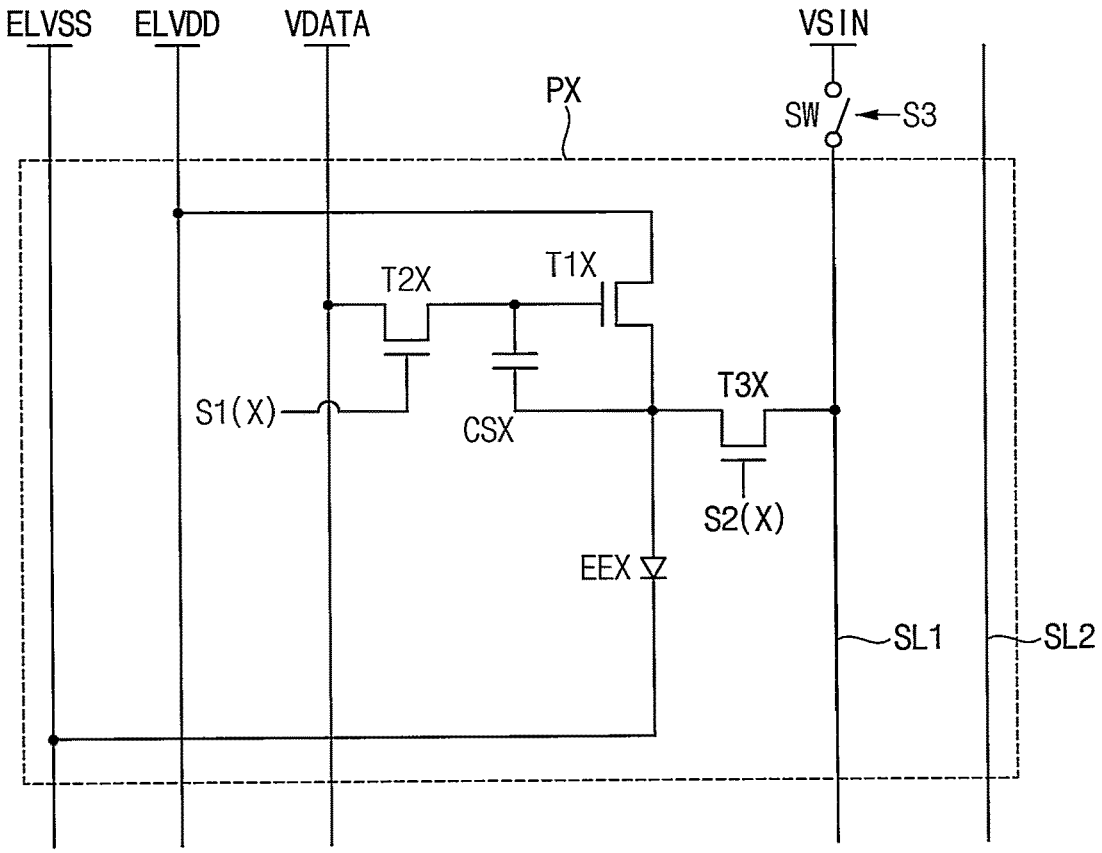
FIG. 11 is a circuit diagram illustrating a third pixel in an area except for the first area of FIG. 4 and the second area of FIG. 4.

FIG. 11 is a circuit diagram illustrating a third pixel in an area except for the first area AM of FIG. 4 and the second area AN of FIG. 4.

Referring to FIGS. 1 to 11, the display panel 100 may further include a third pixel PX disposed between the first pixel PM and the second pixel PN.

The third pixel PX may include a light emitting element EEX, a first switching element T1X, a second switching element T2X and a third switching element T3X like the first pixel PM. In contrast, the third pixel PX may not include a sensing resistor (RM in FIG. 5) and a fourth switching element (T4M in FIG. 5) unlike the first pixel PM. In addition, the first pixel PX may further include a storage capacitor CSX connected between the control electrode of the first switching element T1X and the first electrode of the light emitting element EEX.

The data voltage applied to the second switching element T2M of the first pixel PM may be greater than the data voltage applied to the second switching element T2X of the third pixel PX for the same grayscale value. The first pixel PM includes the sensing resistor RM so that the luminance may be decreased in the first pixel PM due to the sensing resistor RM. Thus, the data voltage which is greater than the data voltage applied to the third pixel PX may be applied to the first pixel PM.

In the illustrated embodiment, the limit value of the first power voltage ELVDD may be determined using the sensing resistors RM and RN and the sensing switching elements T4M and T4N included in the pixel circuit.

In addition, the display apparatus may be driven using the limit value of the first power voltage ELVDD so that the level of the first power voltage ELVDD may not be excessively decreased. Accordingly, the display quality deterioration such as the luminance abnormality or the color coordination abnormality in a portion of the display panel 100 due to the IR drop may be prevented. Thus, the power consumption of the display apparatus may be reduced while maintaining the display quality of the display panel 100.

Figure 12:
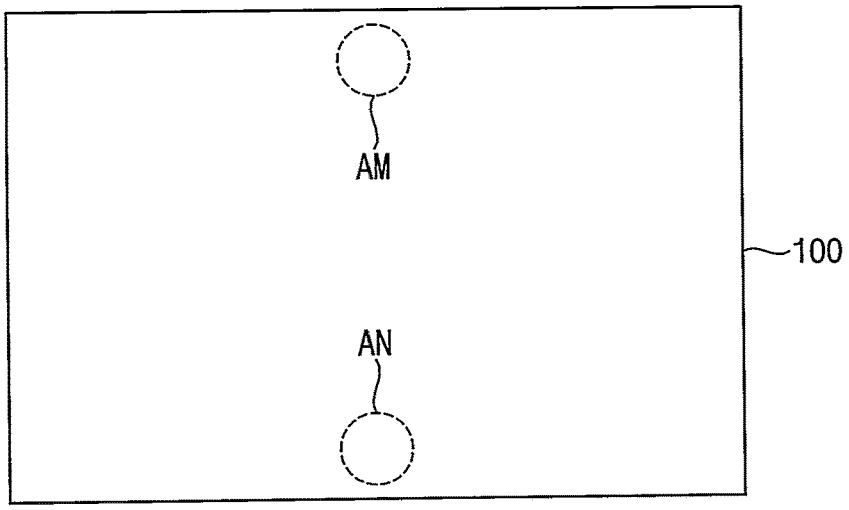
FIG. 12 is a conceptual diagram illustrating an embodiment of a first area and a second area of a display panel of a display apparatus according to the invention.

FIG. 12 is a conceptual diagram illustrating an embodiment of a first area AM and a second area AN of a display panel 100 of a display apparatus according to the invention.

The pixel circuit, the display apparatus and the method of driving the display apparatus in the illustrated embodiment are substantially the same as the pixel circuit, the display apparatus and the method of driving the display apparatus of the previous embodiment explained referring to FIGS. 1 to 11 except for the positions of the first pixel and the second pixel. Thus, the same reference numerals will be used to refer to the same or like parts as those described in the previous embodiment of FIGS. 1 to 11 and any repetitive explanation concerning the above elements will be omitted.

Referring to FIGS. 1 to 3 and 5 to 12, in the illustrated embodiment, when the power voltage generator 600 is disposed adjacent to the lower side of the display panel 100, the first pixel PM may be disposed at a central portion of an upper side of the display panel 100 and the second pixel PN may be disposed at a central portion of the lower side of the display panel 100.

In an embodiment, the IR drop of the first power voltage ELVDD may be most severe in the central portion AM of the upper side of the display panel 100 according to a position and a transmission path to which the first power voltage ELVDD is applied, for example. Thus, when the power voltage generator 600 is disposed adjacent to the lower side of the display panel 100, the first pixel PM may be disposed at the central portion of the upper side of the display panel 100 and the second pixel PN may be disposed at the central portion of the lower side of the display panel 100 so that the difference of the first sensed voltage VM sensed at the fourth switching element T4M of the first pixel PM and the second sensed voltage VN sensed at the fourth switching element T4N of the second pixel PN may be determined.

In the illustrated embodiment, the limit value of the first power voltage ELVDD may be determined using the sensing resistors RM and RN and the sensing switching elements T4M and T4N included in the pixel circuit.

In addition, the display apparatus may be driven using the limit value of the first power voltage ELVDD so that the level of the first power voltage ELVDD may not be excessively decreased. Accordingly, the display quality deterioration such as the luminance abnormality or the color coordination abnormality in a portion of the display panel 100 due to the IR drop may be prevented. Thus, the power consumption of the display apparatus may be reduced while maintaining the display quality of the display panel 100.

Figure 13:
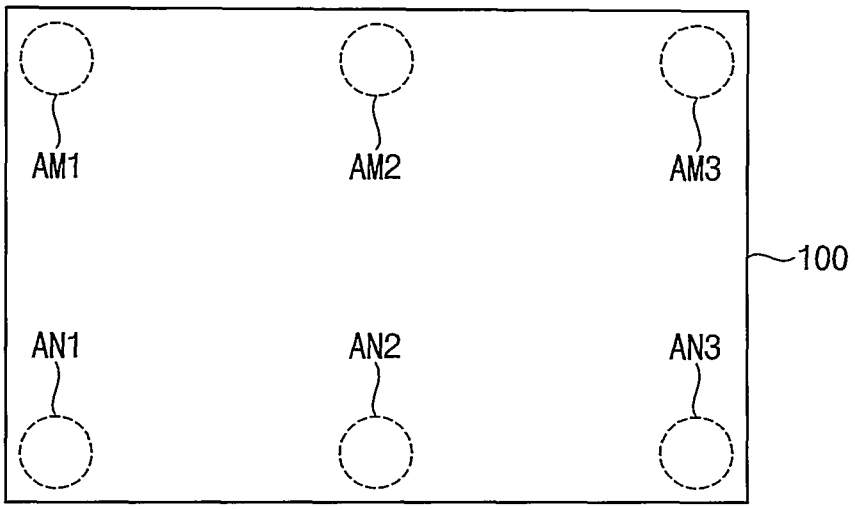
FIG. 13 is a conceptual diagram illustrating an embodiment of a first area, a second area, a third area, a fourth area, a fifth area and a sixth area of a display panel of a display apparatus according to the invention.

FIG. 13 is a conceptual diagram illustrating an embodiment of a first area, a second area, a third area, a fourth area, a fifth area and a sixth area of a display panel of a display apparatus according to the invention.

The pixel circuit, the display apparatus and the method of driving the display apparatus in the illustrated embodiment are substantially the same as the pixel circuit, the display apparatus and the method of driving the display apparatus of the previous embodiment explained referring to FIGS. 1 to 11 except for the positions of the first pixel and the second pixel. Thus, the same reference numerals will be used to refer to the same or like parts as those described in the previous embodiment of FIGS. 1 to 11 and any repetitive explanation concerning the above elements will be omitted.

Referring to FIGS. 1 to 3, 5 to 11 and 13, in the illustrated embodiment, the display panel 100 may further include third to sixth pixels.

The first pixel PM disposed in the first area AM1 may include a light emitting element EEM, a first switching element T1M applying the first power voltage ELVDD to a first electrode of the light emitting element EEM, a second switching element T2M applying the data voltage VDATA to a control electrode of the first switching element T1M, a third switching element T3M sensing a signal of the first electrode of the light emitting element EEM, a sensing resistor RM including a first end connected to a second electrode of the light emitting element EEM and a second end receiving the second power voltage ELVSS and a fourth switching element T4M sensing a signal of the second electrode of the light emitting element EEM. In addition, the first pixel PM may further include a storage capacitor CSM connected between the control electrode of the first switching element T1M and the first electrode of the light emitting element EEM.

The second pixel PN disposed in the second area AN1 may include a light emitting element EEN, a first switching element T1N applying the first power voltage ELVDD to a first electrode of the light emitting element EEN, a second switching element T2N applying the data voltage VDATA to a control electrode of the first switching element T1N, a third switching element T3N sensing a signal of the first electrode of the light emitting element EEN, a sensing resistor RN including a first end connected to a second electrode of the light emitting element EEN and a second end receiving the second power voltage ELVSS and a fourth switching element T4N sensing a signal of the second electrode of the light emitting element EEN. In addition, the second pixel PN may further include a storage capacitor CSN connected between the control electrode of the first switching element T1N and the first electrode of the light emitting element EEN.

Each of the third to sixth pixels respectively disposed in third to sixth areas AM2, AN2, AM3 and AN3 may include a light emitting element, a first switching element applying the first power voltage ELVDD to a first electrode of the light emitting element, a second switching element applying the data voltage VDATA to a control electrode of the first switching element, a third switching element sensing a signal of the first electrode of the light emitting element, a sensing resistor including a first end connected to a second electrode of the light emitting element and a second end receiving the second power voltage ELVSS and a fourth switching element sensing a signal of the second electrode of the light emitting element like the first pixel PM and the second pixel PN of FIG. 5.

When the power voltage generator 600 is disposed adjacent to a lower side of the display panel 100, the first pixel may be disposed at an upper portion AM1 of a first lateral side (e.g., left side in FIG. 13) perpendicular to the lower side, the second pixel may be disposed at a lower portion AN1 of the first lateral side, the third pixel may be disposed at a central portion AM2 of an upper side of the display panel 100, the fourth pixel may be disposed at a central portion AN2 of the lower side of the display panel 100, the fifth pixel may be disposed at an upper portion AM3 of a second lateral side (e.g., right side) opposite to the first lateral side and the sixth pixel may be disposed at a lower portion AN3 of the second lateral side.

In FIG. 4, the first pixel and the second pixel are disposed corresponding to one lateral side of the display panel 100. In FIG. 12, the first pixel and the second pixel are disposed corresponding to a laterally central portion of the display panel 100.

In an embodiment, the IR drop of the first power voltage ELVDD may be severe in upper corner portions AM1 and AM3 and the central portion AM2 of the upper side of the display panel 100 according to a position and a transmission path to which the first power voltage ELVDD is applied, for example. Thus, when the power voltage generator 600 is disposed adjacent to the lower side of the display panel 100, the first pixel and the second pixel are disposed along the first lateral side of the display panel 100, the third pixel and the fourth pixel are disposed along a laterally central line of the display panel 100 and the fifth pixel and the sixth pixel are disposed along the second lateral side of the display panel 100 so that the difference of a sensed voltage sensed at an upper portion of the display panel 100 and a sensed voltage sensed at a lower portion of the display panel 100 may be determined.

In the illustrated embodiment, the limit value of the first power voltage ELVDD may be determined using the sensing resistor and the sensing switching element included in the pixel circuit.

In addition, the display apparatus may be driven using the limit value of the first power voltage ELVDD so that the level of the first power voltage ELVDD may not be excessively decreased. Accordingly, the display quality deterioration such as the luminance abnormality or the color coordination abnormality in a portion of the display panel 100 due to the IR drop may be prevented. Thus, the power consumption of the display apparatus may be reduced while maintaining the display quality of the display panel 100.

Figure 14:
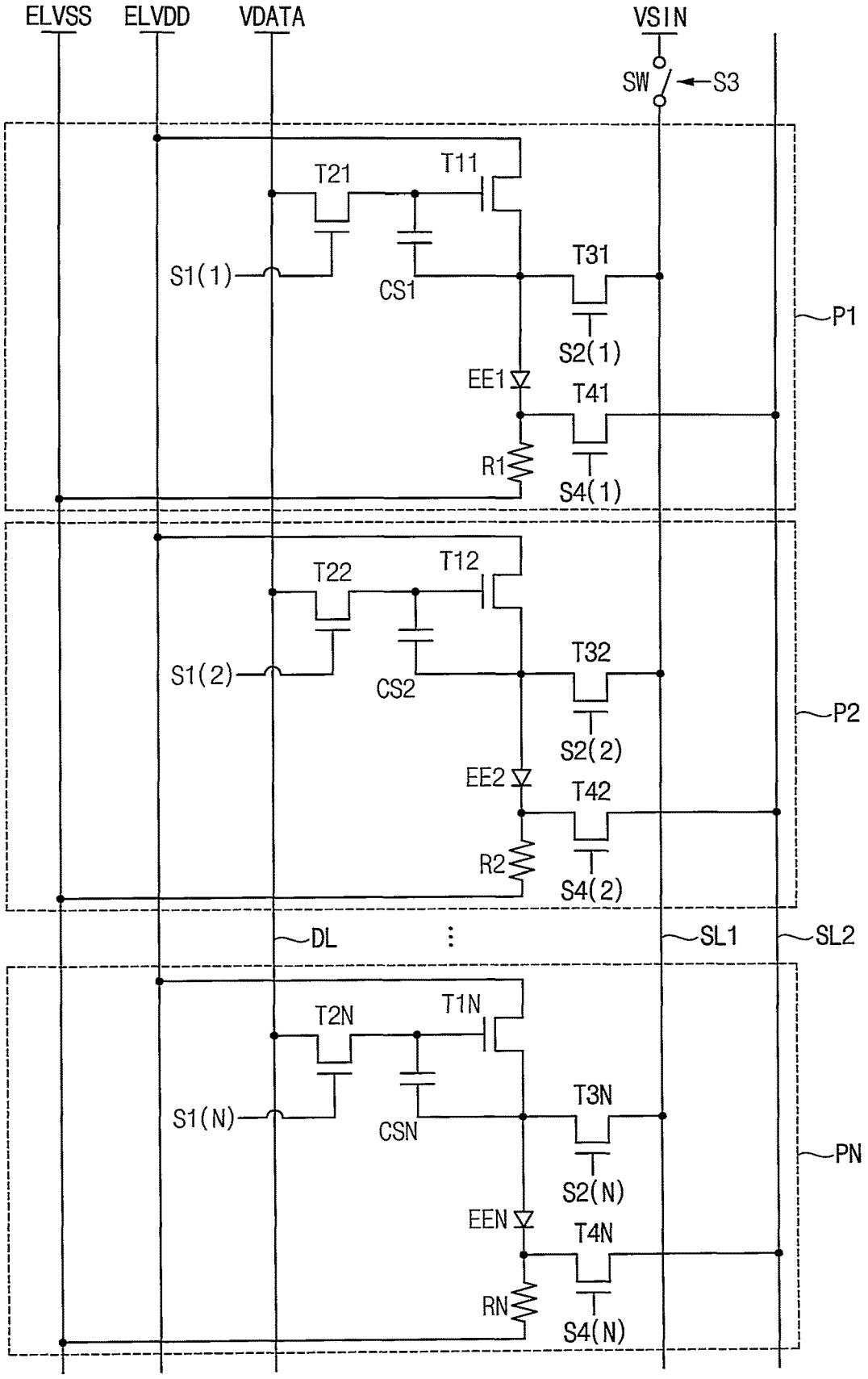
FIG. 14 is a circuit diagram illustrating an embodiment of pixels of a display panel of a display apparatus according to the invention.

FIG. 14 is a circuit diagram illustrating an embodiment of pixels P1, P2, PN of a display panel 100 of a display apparatus according to the invention.

The pixel circuit, the display apparatus and the method of driving the display apparatus in the illustrated embodiment are substantially the same as the pixel circuit, the display apparatus and the method of driving the display apparatus of the previous embodiment explained referring to FIGS. 1 to 11 except that all of the pixels include the sensing resistors and the fourth switching elements. Thus, the same reference numerals will be used to refer to the same or like parts as those described in the previous embodiment of FIGS. 1 to 11 and any repetitive explanation concerning the above elements will be omitted.

When the all of the pixels include the sensing resistors and the fourth switching elements, the IR drop of the first power voltage ELVDD may be accurately measured and the first power voltage ELVDD may be finely adjusted.

A first pixel P1 of the display panel 100 may include a light emitting element EE1, a first switching element T11 applying the first power voltage ELVDD to a first electrode of the light emitting element EE1, a second switching element T21 applying the data voltage VDATA to a control electrode of the first switching element T11, a third switching element T31 sensing a signal of the first electrode of the light emitting element EE1, a sensing resistor R1 including a first end connected to a second electrode of the light emitting element EE1 and a second end receiving the second power voltage ELVSS and a fourth switching element T41 sensing a signal of the second electrode of the light emitting element EEL In addition, the first pixel P1 may further include a storage capacitor CS1 connected between the control electrode of the first switching element T11 and the first electrode of the light emitting element EE1.

A second pixel P2 of the display panel 100 disposed adjacent to the first pixel P1 in a vertical direction may include a light emitting element EE2, a first switching element T12 applying the first power voltage ELVDD to a first electrode of the light emitting element EE2, a second switching element T22 applying the data voltage VDATA to a control electrode of the first switching element T12, a third switching element T32 sensing a signal of the first electrode of the light emitting element EE2, a sensing resistor R2 including a first end connected to a second electrode of the light emitting element EE2 and a second end receiving the second power voltage ELVSS and a fourth switching element T42 sensing a signal of the second electrode of the light emitting element EE2. In addition, the first pixel P2 may further include a storage capacitor CS2 connected between the control electrode of the first switching element T12 and the first electrode of the light emitting element EE2.

A lowermost pixel PN of the display panel 100 disposed in a pixel column including the first pixel P1 and the second pixel P2 may include a light emitting element EEN, a first switching element T1N applying the first power voltage ELVDD to a first electrode of the light emitting element EEN, a second switching element T2N applying the data voltage VDATA to a control electrode of the first switching element T1N, a third switching element T3N sensing a signal of the first electrode of the light emitting element EEN, a sensing resistor RN including a first end connected to a second electrode of the light emitting element EEN and a second end receiving the second power voltage ELVSS and a fourth switching element T4N sensing a signal of the second electrode of the light emitting element EEN. In addition, the lowermost pixel PN may further include a storage capacitor CSN connected between the control electrode of the first switching element T1N and the first electrode of the light emitting element EEN.

In the illustrated embodiment, the limit value of the first power voltage ELVDD may be determined using the sensing resistors R1, R2 and RN and the sensing switching elements T41, T42 and T4N included in the pixel circuit.

In addition, the display apparatus may be driven using the limit value of the first power voltage ELVDD so that the level of the first power voltage ELVDD may not be excessively decreased. Accordingly, the display quality deterioration such as the luminance abnormality or the color coordination abnormality in a portion of the display panel 100 due to the IR drop may be prevented. Thus, the power consumption of the display apparatus may be reduced while maintaining the display quality of the display panel 100.

By the embodiments of the pixel circuit and the display apparatus, the power consumption of the display apparatus may be reduced while maintaining the display quality of the display panel.

The foregoing is illustrative of the invention and is not to be construed as limiting thereof. Although a few embodiments of the invention have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A pixel circuit comprising:

a light emitting element including a first electrode and a second electrode;

a first switching element which applies a first power voltage to the first electrode of the light emitting element and includes a control electrode;

a second switching element which applies a data voltage to the control electrode of the first switching element;

a third switching element which senses a signal of the first electrode of the light emitting element;

a sensing resistor including a first end connected to the second electrode of the light emitting element and a second end which receives a second power voltage; and a fourth switching element which senses a signal of the second electrode of the light emitting element and connected to the first end of the sensing resistor.

2. The pixel circuit of claim 1, wherein, in a first sensing mode, a first switching signal applied to a control electrode of the second switching element has an inactive level, a second switching signal applied to a control electrode of the third switching element has an inactive level and a fourth switching signal applied to a control electrode of the fourth switching element has an active level.

3. The pixel circuit of claim 2, wherein, in a second sensing mode, the first switching signal has the inactive level, the second switching signal has an active level and the fourth switching signal has an inactive level.

4. The pixel circuit of claim 3, further comprising an initialization voltage applying switch which applies an initialization voltage to a first sensing line connected to an output electrode of the third switching element.

5. The pixel circuit of claim 4, wherein, in an initialization voltage applying mode, the first switching signal has an active level, the second switching signal has the active level, a third switching signal applied to the initialization voltage applying switch has an active level and the fourth switching signal has the inactive level.

6. A display apparatus comprising:

a display panel including a first pixel and a second pixel, each of the first pixel and the second pixel comprising:

a light emitting element including a first electrode and a second electrode;

a first switching element which applies a first power voltage to the first electrode of the light emitting element and includes a control electrode;

a second switching element which applies a data voltage to the control electrode of the first switching element;

a third switching element which senses a signal of the first electrode of the light emitting element;

a sensing resistor including a first end connected to the second electrode of the light emitting element and a second end which receives a second power voltage; and a fourth switching element which senses a signal of the second electrode of the light emitting element and connected to the first end of the sensing resistor;

a data driver which applies the data voltage to the display panel; and a power voltage generator which applies a power voltage to the display panel, wherein a distance between the first pixel and the power voltage generator is greater than a distance between the second pixel and the power voltage generator.

7. The display apparatus of claim 6, wherein the display panel further comprises a third pixel, and wherein the third pixel comprises the light emitting element, the first switching element, the second switching element and the third switching element, and wherein the third pixel does not comprise the sensing resistor and the fourth switching element.

8. The display apparatus of claim 7, wherein a data voltage applied to the second switching element of the first pixel is greater than a data voltage applied to the second switching element of the third pixel for a same grayscale value.

9. The display apparatus of claim 6, wherein a limit value of the first power voltage is determined using a difference of a first sensed voltage sensed at the fourth switching element of the first pixel and a second sensed voltage sensed at the fourth switching element of the second pixel.

10. The display apparatus of claim 9, wherein as the first power voltage is gradually decreased from a maximum setting value, a minimum value of the first power voltage at which the difference of the first sensed voltage sensed at the fourth switching element of the first pixel and the second sensed voltage sensed at the fourth switching element of the second pixel is maintained constantly is determined as the limit value of the first power voltage.

11. The display apparatus of claim 9, further comprising a driving controller which controls the data driver and the power voltage generator, wherein the driving controller compensates the first power voltage using the limit value of the first power voltage.

12. The display apparatus of claim 6, wherein when the power voltage generator is disposed adjacent to a lower side of the display panel, the first pixel is disposed at an upper portion of a first lateral side perpendicular to the lower side and the second pixel is disposed at a lower portion of the first lateral side.

13. The display apparatus of claim 6, wherein when the power voltage generator is disposed adjacent to a lower side of the display panel, the first pixel is disposed at a central portion of an upper side of the display panel and the second pixel is disposed at a central portion of the lower side of the display panel.

14. The display apparatus of claim 6, wherein the display panel further comprises third to sixth pixels, and wherein each of the third to sixth pixels comprises:

a light emitting element including a first electrode and a second electrode;

a first switching element which applies the first power voltage to the first electrode of the light emitting element and includes a control electrode;

a second switching element which applies the data voltage to the control electrode of the first switching element;

a third switching element which senses a signal of the first electrode of the light emitting element;

a sensing resistor including a first end connected to the second electrode of the light emitting element and a second end which receives the second power voltage; and a fourth switching element which senses a signal of the second electrode of the light emitting element.

15. The display apparatus of claim 14, wherein when the power voltage generator is disposed adjacent to a lower side of the display panel, the first pixel is disposed at an upper portion of a first lateral side perpendicular to the lower side, the second pixel is disposed at a lower portion of the first lateral side, the third pixel is disposed at a central portion of an upper side of the display panel, the fourth pixel is disposed at a central portion of the lower side of the display panel, the fifth pixel is disposed at an upper portion of a second lateral side opposite to the first lateral side and the sixth pixel is disposed at a lower portion of the second lateral side.

16. The display apparatus of claim 6, wherein, in a first sensing mode, a first switching signal applied to a control electrode of the second switching element has an inactive level, a second switching signal applied to a control electrode of the third switching element has an inactive level and a fourth switching signal applied to a control electrode of the fourth switching element has an active level.

17. The display apparatus of claim 16, wherein, in a second sensing mode, the first switching signal has the inactive level, the second switching signal has an active level and the fourth switching signal has an inactive level.

18. The display apparatus of claim 17, wherein the display panel further comprises an initialization voltage applying switch which applies an initialization voltage to a first sensing line connected to an output electrode of the third switching element.

19. The display apparatus of claim 18, wherein, in an initialization voltage applying mode, the first switching signal has an active level, the second switching signal has the active level, a third switching signal applied to the initialization voltage applying switch has an active level and the fourth switching signal has the inactive level.

20. A method of driving a display apparatus, the method comprising:

sensing a first voltage from a cathode electrode of a light emitting element of a first pixel;

sensing a second voltage from a cathode electrode of a light emitting element of a second pixel disposed closer to a power voltage generator than the first pixel is to the power voltage generator; and determining a limit of a first power voltage which is applied from the power voltage generator to the first pixel and the second pixel based on a difference between the first voltage and the second voltage.

* * * * *